United States Patent [19]

Dernedde et al.

[11] Patent Number: 4,518,311

[45] Date of Patent: May 21, 1985

[54] CENTRIFUGAL PUMP

[75] Inventors: Robert Dernedde, Frankenthal; Hans-Joachim Franke, Grünstadt; Peter Havekost, Bobenheim, all of Fed. Rep. of Germany

[73] Assignee: Klein, Schanzlin & Becker Aktiengesellschaft, Frankenthal, Fed. Rep. of Germany

[21] Appl. No.: 192,294

[22] Filed: Sep. 30, 1980

[30] Foreign Application Priority Data

Oct. 3, 1979 [DE] Fed. Rep. of Germany ..... 2940058

[51] Int. Cl.[3] ..... F04D 29/40

[52] U.S. Cl. ..... 415/102; 415/206; 415/219 R; 415/219 B; 415/219 C

[58] Field of Search ..... 415/206, 219 C, 219 R, 415/219 A, 219 B, DIG. 3, 102; 285/187, DIG. 6, 347, 231, 302, 166; 417/407

[56] References Cited

U.S. PATENT DOCUMENTS

| | | | |
|---|---|---|---|
| 338,783 | 3/1886 | Ritchie | 285/187 |
| 948,858 | 2/1910 | Henry | 285/166 |
| 1,663,998 | 3/1928 | Schmidt | 415/219 C |
| 2,144,417 | 1/1939 | Schneible | 415/219 B |
| 2,438,312 | 3/1948 | Bunn et al. | 285/187 |
| 2,502,753 | 4/1950 | Rohr | 285/166 |
| 2,649,315 | 8/1953 | Ipsen | 285/DIG. 6 |
| 3,459,133 | 8/1969 | Scheffler | 415/219 B |
| 3,544,233 | 7/1968 | Brown et al. | 415/219 R |
| 3,635,579 | 1/1972 | Wood | 415/219 C |
| 3,733,145 | 5/1973 | Kaplansky et al. | 415/219 C |

FOREIGN PATENT DOCUMENTS

| | | | |
|---|---|---|---|
| 600337 | 6/1960 | Canada | 415/219 C |

*Primary Examiner*—Samuel Scott
*Assistant Examiner*—Brian J. Bowman
*Attorney, Agent, or Firm*—Peter K. Kontler

[57] ABSTRACT

A centrifugal pump has a casing with a cylindrical shell surrounding a volute-type inner section which is formed with a hollow radial extension for admission of fluid into a nipple of the shell. The extension forms part of or constitutes a separable sealing device between a passage of the inner section and a passage of the shell. The inner section is suspended in the shell by one or more pipes which are coaxial with the rotor and/or by one or more projections which extend radially from the inner section and abut against the internal surface of the shell or extend into recesses provided therefor in the internal surface of the shell.

28 Claims, 11 Drawing Figures

CENTRIFUGAL PUMP

BACKGROUND OF THE INVENTION

The present invention relates to centrifugal pumps in general, and more particularly to improvements in centrifugal pumps of the type wherein the casing includes several sections, especially a volute-type inner section and a cylindrical outer section or shell. Centrifugal pumps of the just outlined character can be used with advantage as feed pumps in power plants or the like.

It is already known to provide a high pressure centrifugal pump with a casing which includes a volute-type inner section and an outer section or shell which surrounds the inner section. Such casings are often used in multistage centrifugal pumps which are installed in power plants or like institutions wherein the pumps must deliver a hydraulic fluid at elevated pressure. The provision of a twin- or multiple-component casing contributes to the safety of operation. The shell surrounds all pressure generating and fluid conveying components including the aforementioned volute-type inner section. As a rule, the inner section of a conventional centrifugal pump with a multiple-component casing is welded to and thus permanently connected with the outer section or shell.

It is further known to use a composite or multi-component casing in connection with single-stage pumps. In such pumps (reference may be had to German Offenlegungsschrift No. 2,640,886), the volute-type inner section serves as a guide means for the fluid. Here, again, the inner section which guides and conveys the fluid is welded to the outer section or shell of the pump casing.

The just discussed conventional centrifugal pumps with multi-component casings wherein an outer component surrounds an inner component exhibit a number of serious drawbacks.

For example, if the volute-type inner section of the casing is damaged (e.g., owing to cavitation), the permanent (welded) connection between the inner and outer sections of the casing presents many problems preparatory to gaining adequate access to the inner section for the purposes of repair, i.e., the welded seam or seams between the inner and outer sections must be destroyed and reestablished when the repaired inner section is to be reinstalled in the outer section of the casing.

Another serious drawback of the aforediscussed conventional casings is that the making of welded seams between the inner and outer sections of the pump casing presents many problems. The locations of such seams are not readily accessible and the configuration of the seams is often extremely complex so that they cannot be formed by resorting to available automatic welding equipment. For example, a seam must be formed between the tubular elements through which fluid flows from the exterior of the outer section into the interior of the inner section or vice versa. This is normally accomplished by providing the outer section with an integral inwardly extending nipple which is welded to the inner section. The making of such nipple and its bonding to the inner section contribute significantly to the cost of the pump casing. Moreover, the quality of the welded seam or seams between the inner and outer sections of the casing must be tested with a high degree of accuracy. This also presents many problems because it is difficult to properly position the testing equipment (e.g., a source of X-rays and X-ray film) with reference to the seam or seams. The same holds true if the testing equipment employs other sources of penetrative radiation and one or more transducers which ascertain the percentage of radiation that is absorbed by the material of the seam and/or by the adjacent material of the inner or outer section of the casing.

The number of materials which can be used to make the outer section of the casing in a conventional pump is rather limited because the material must be such that the outer section can be readily and reliably welded to the inner section. As a rule, the quality of the metal (e.g., an alloy) which is used to make the inner section is higher than the quality of the metal which is used to make the pipes serving to deliver fluid to or remove fluid from the centrifugal pump. The quality of the material of the outer section of the casing is somewhere between the qualities of the material of the inner section and the material of the piping. The term "quality" is intended to denote in particular the weldability of the materials of various components of the pump and of the parts which are connected to the pump casing. The quality of the material of the inner section of the casing must be high in order to enable the inner section to stand long periods of use in spite of the very high speed of the fluid that flows therethrough.

The presence of welded seams between the inner and outer sections of a composite or multi-component pump casing is undesirable when the temperature of the conveyed fluid is very high or very low and the heat expansion coefficient of the material of the inner section is different from that of the material of the outer section. Unequal expansion and resulting distortion of the components of the casing can lead to pronounced shifting of the stator relative to the rotor of the centrifugal pump with adverse effects upon the reliability and safety of operation. Moreover, the wear upon the parts increases in response to pressure- or heat-induced distortion which cannot be compensated for by at least some movement of the inner section with reference to the outer section of the casing or vice versa.

OBJECTS AND SUMMARY OF THE INVENTION

An object of the invention is to provide a novel and improved centrifugal pump wherein a composite casing is constructed and assembled in such a way that the casing can be dismantled in a time-saving operation, that the heating or cooling of various components of the casing to different temperatures does not readily affect the operation of the pump, and that removal of the inner section from the outer section of the pump casing does not necessitate destruction of permanent bonds between such sections.

Another object of the invention is to provide a casing of the just outlined character wherein the inner section can be readily and accurately centered in the outer section in spite of the absence of permanent connections between such sections.

A further object of the invention is to provide a casing whose components can be manufactured of a wide variety of materials without affecting the reliability of operation at elevated pressures, at elevated temperatures and/or at low or very low temperatures.

An additional object of the invention is to provide a casing which is less expensive and simpler than but at least as satisfactory as heretofore known casings for use in high pressure centrifugal pumps of the type requiring the utilization of casings with several components which surround each other to enhance the resistance to pressure and the safety of operation.

The invention is embodied in a centrifugal pump, particularly in a high pressure centrifugal pump for use in power plants, nuclear reactor plants or the like. The pump comprises a casing or housing including a volute-type inner section (e.g. a casting) and a pressure resistant outer section (e.g., a cylindrical shell) which surrounds the inner section. The sections have passages for the flow of a fluid medium therethrough, and the pump further comprises separable sealing means interposed between the two passages. Such sealing means may comprise a cylindrical or otherwise configurated radially outwardly projecting extension of the inner section which is received in a recess machined into the internal surface of the outer section. The extension can be bolted to the outer section or is free to move radially of the outer section. Still further, the pump comprises means (e.g., one or more tubes which are integral or connected with the inner section and are secured to or reciprocable in and axially of the outer section, or several external projections provided on the inner section and abutting against the internal surface of the outer section or extending into recesses provided therefor in the internal surface of the outer section) for suspending the inner section in the outer section. The suspending means, as well as the sealing means, are preferably devoid of welded seams so that the two sections of the casing can be readily taken apart when the need arises, e.g., to inspect the inner section for the presence or absence of damage caused by cavitation or other undesirable influences which develop when the pump is in use.

A sealing ring can be interposed between the extension of the inner section and the surface bounding the corresponding recess in the internal surface of the outer section. The extension preferably admits fluid into the passage of a radial nipple which forms part of the outer section.

Alternatively, the sealing means may comprise a tubular insert which is introduced into the recess in the internal surface of the outer section prior to insertion of the inner section into the outer section. The ends of the tubular or cylindrical part of the outer section are sealed by detachable rigid covers which can carry the ends of a pipe constituting or forming part of the aforementioned means for suspending the inner section in the outer section.

The novel features which are considered as characteristic of the invention are set forth in particular in the appended claims. The improved centrifugal pump itself, however, both as to its construction and the mode of assembling the same, together with additional features and advantages thereof, will be best understood upon perusal of the following detailed description of certain specific embodiments with reference to the accompanying drawing.

DESCRIPTION OF THE PREFERRED EMBODIMENTS

Figure 1:
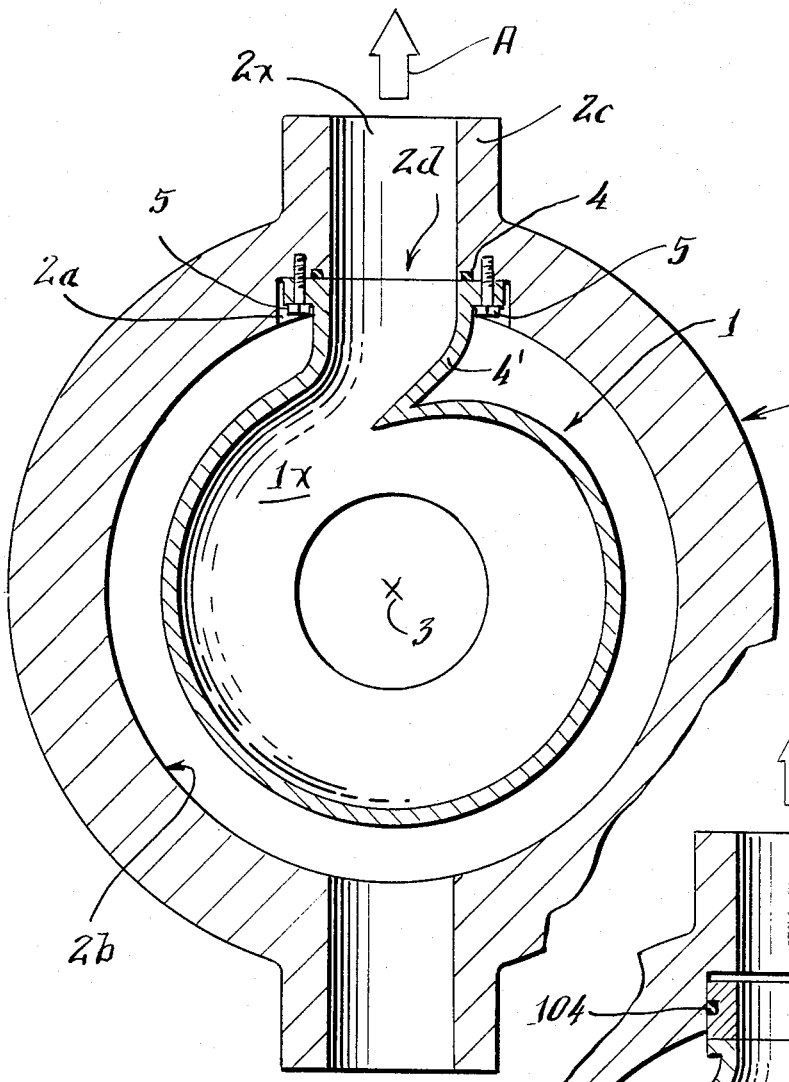
FIG. 1 is a transverse sectional view of a centrifugal pump which embodies one form of the invention and wherein a hollow extension of the volute-type inner section projects into and is secured in a recess which is machined into the internal surface of the outer section so that the pressurized fluid can flow into the outlet nipple of the casing.

FIG. 1 illustrates a casing which forms part of a high pressure centrifugal pump and is constructed and assembled in accordance with a first embodiment of the invention. The casing comprises an outer section 2 which is a cylindrical shell and surrounds a volute-type inner section 1. The rotor axis is indicated at 3. The inner section 1 comprises a substantially radially outwardly projecting hollow cylindrical or otherwise configurated extension 4' with a flat end face. The extension 4' is received in a recess **2*a* which is machined into the internal surface 2*b* of the shell 2. A sealing ring 4 is removably inserted between the internal surface of the shell 2 (i.e., between the surface 2*d* at the bottom of the recess 2*a*) and the adjacent flat external surface or end face of the extension 4'. The extension 4' provides a path for the flow of fluid from a passage 1*x* in the interior of the inner section 1 into the bore or passage 2*x* of a nipple 2*c* forming part of the shell 2. The direction of fluid flow is indicated by the arrow A. The means for separably securing the extension 4' to the shell 2 comprises several bolts, screws or analogous threaded fasteners 5. The surface 2*d* at the bottom of the recess 2*a* in the internal surface 2*b* of the shell 2 is flat and is substantially tangential to the shell. The fasteners 5 are drawn tight with a sufficient force to ensure that the ring 4 establishes a leakproof seal between the internal surface of the shell 2 and the external surface of the extension 4'**

(i.e., the external surface of a portion of the inner section 1 of the casing).

Figure 2:
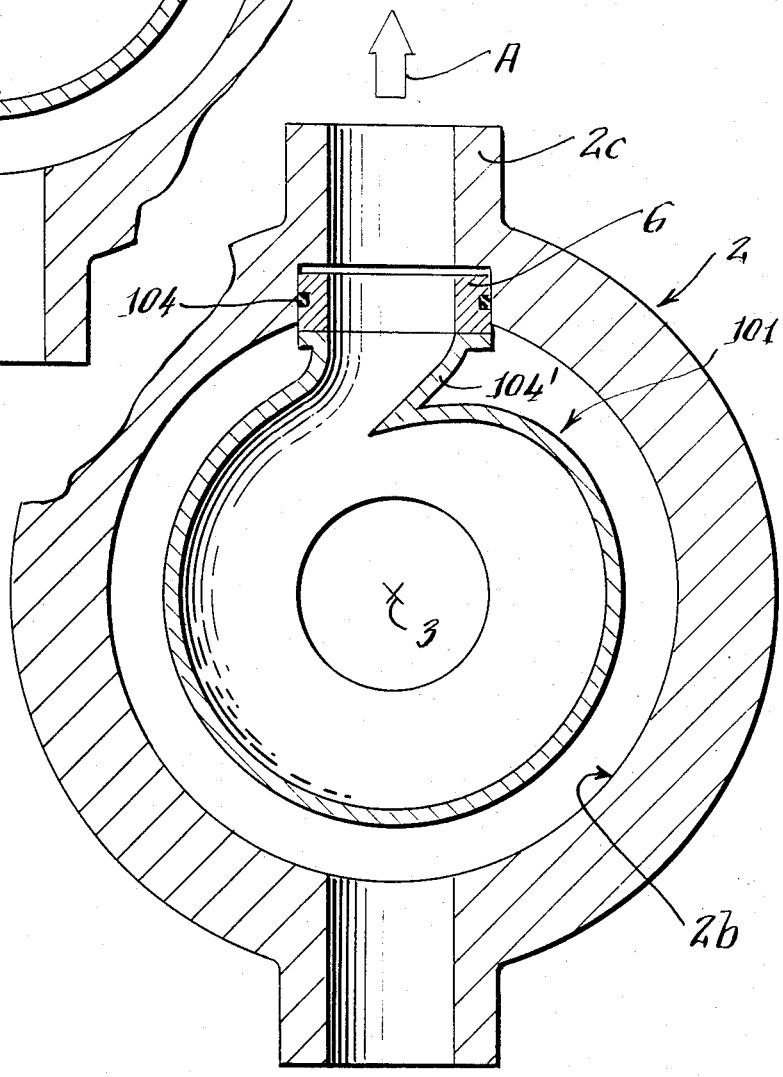
FIG. 2 is a similar transverse sectional view of a second pump wherein the means for establishing a seal between the extension of the inner section and the outer section includes a tubular insert which is reciprocable in the internal recess of the outer section.

In the embodiment of FIG. 2, the outer section or shell 2 surrounds a modified volute-type inner section 101. The extension 104' of the inner section 101 does not project into the recess 2*a* of the internal surface 2*b* of the shell 2. The sealing means between the sections 101 and 2 of the casing comprises the extension 104' and a tubular insert 6 which resembles a plunger and is separably or permanently secured to the extension 104'. The insert 6 extends into the recess 2*a* and has a circumferential groove for a sealing ring 104. The depth of the recess 2*a* is such that the plunger-like insert 6 has some freedom of movement radially of the shell 2.

An advantage of the centrifugal pump which embodies the structure of FIG. 2 is that the inner section 101 can be even more readily removed from the shell 2 and also that the section 101 can expand or contract independently of the shell 2 or vice versa (note the absence of the threaded fasteners 5 which are used in the embodiment of FIG. 1). Moreover, the inner section 101 can be fitted into any one of a series of shells 2 having differently oriented nipples 2*c*. Still further, the width of the radial clearance between the shell 2 and the inner section 101 can be greatly reduced because the tubular insert 6 can be introduced into the recess 2*a* prior to introduction of the inner section 101 into the shell 2.

Figure 3:
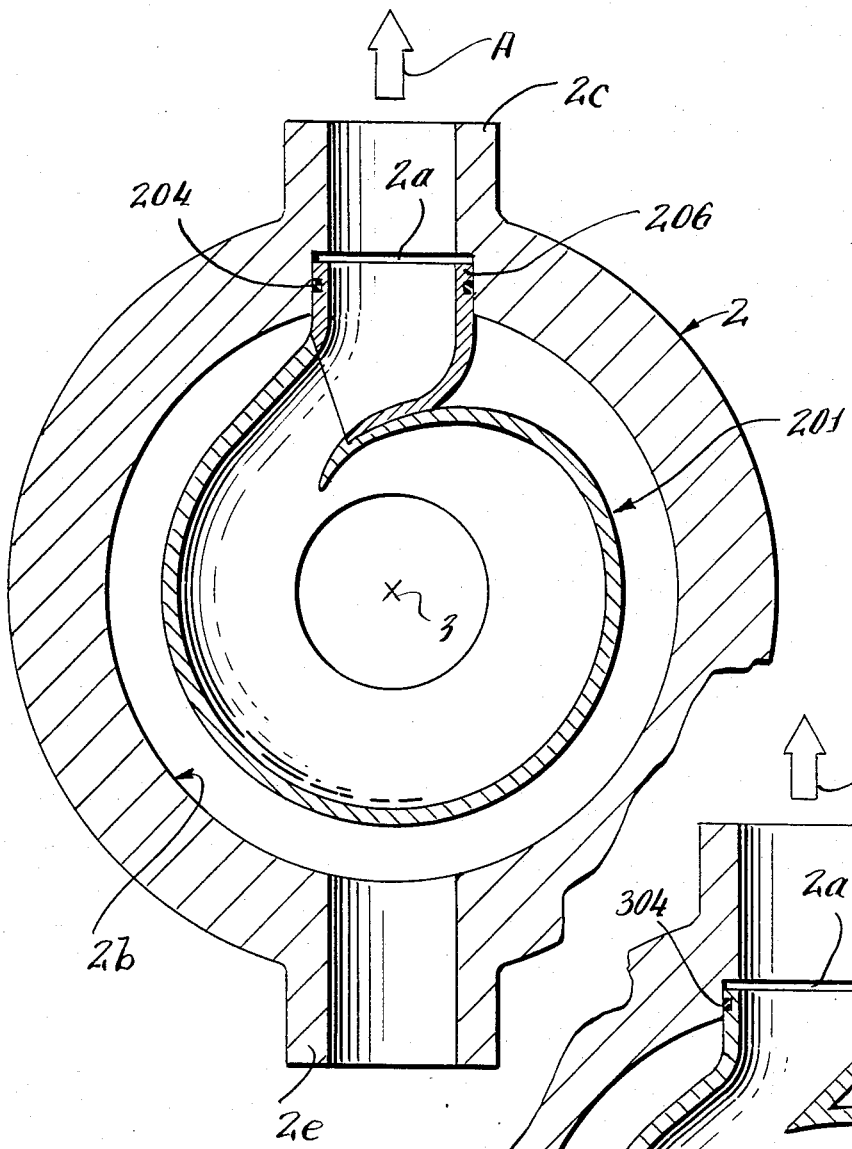
FIG. 3 is a similar transverse sectional view of a third centrifugal pump wherein a separately machined extension of the inner section is reciprocable in the recess of the internal surface of the outer section of the casing.

FIG. 3 shows a modification 201 of the inner section 101. The inner section 201 is separably connected with a different insert 206 which forms part of the sealing means between the inner section 201 and outer section or shell 2 of the casing. The insert 206 is surrounded by a sealing ring 204 and is reciprocable in the recess 2*a* substantially radially of the shell 2. The reference character 2*e* denotes a fluid-admitting second nipple which is disposed diametrically opposite the nipple 2*c*.

Figure 4:
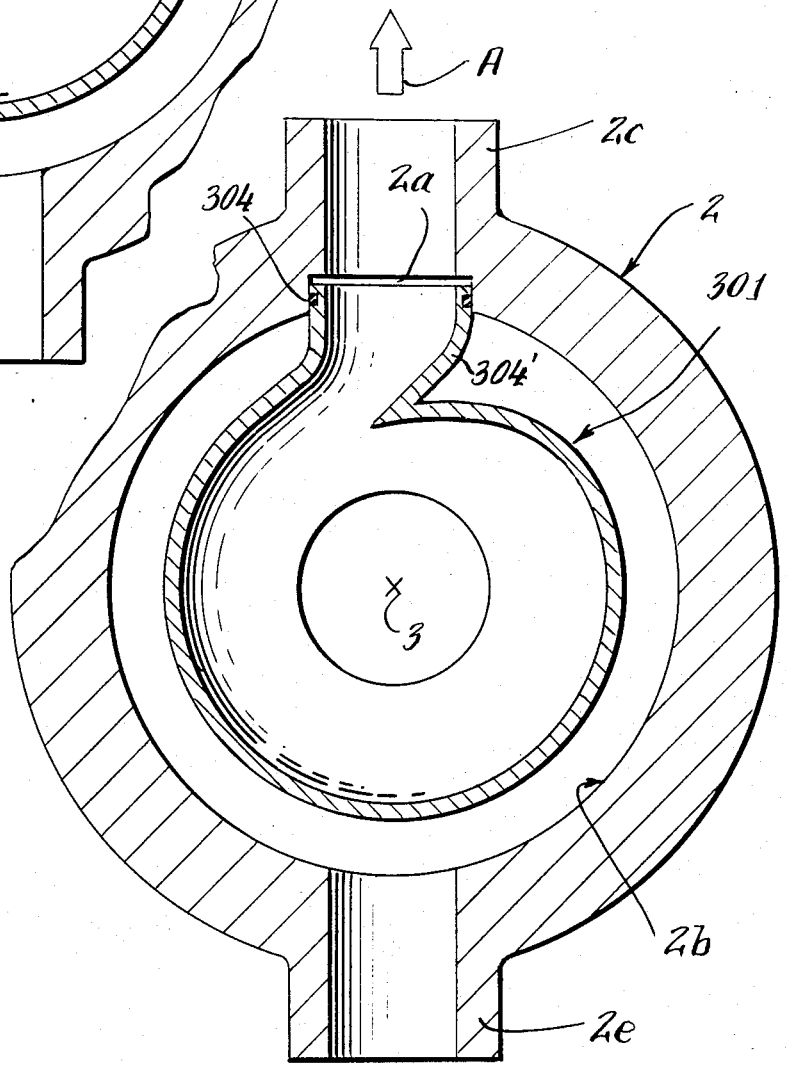
FIG. 4 is a transverse sectional view of a pump which is similar to that of FIG. 3 except that the extension is an integral part of the inner section.

Referring to FIG. 4, there is shown a portion of a centrifugal pump wherein the casing comprises a cylindrical outer portion or shell 2 and a volute-type inner section 301 having an integral cylindrical extension 304' the outer portion of which is reciprocable in the radial recess 2*a* of the internal surface 2*b*. The extension 304' is surrounded by a sealing ring 304 which engages the shell 2.

The dimensions and the material of the extension 304' can be selected in such a way that the latter expands in response to increasing pressure in the inner section 301 and urges the sealing ring 304 into more pronounced sealing engagement with the cylindrical surface surrounding the recess 2*a*. In fact, the extension 304' can expand into direct contact with the shell 2. The extension 304' supplies pressurized fluid to the nipple 2*c*. Increasing pressure in the interior of the inner section 301 can cause at least some movement of the extension 304' radially of and away from the rotor axis 3, i.e., deeper into the recess 2*a*.

It will be noted that FIGS. 1 to 4 show four different modes of providing separable sealing means between the inner and outer sections of the casing of a centrifugal pump without resort to welded seams. The nature of sealing means shown in FIGS. 2–4 is such that the inner section 101, 201 or 301 can move radially of the outer section or shell 2. In fact, the sealing means (such as that including the insert 6 and its ring 104) can move radially of the shell 2, i.e., radially of the rotor axis 3. This is desirable and advantageous because the heat expansion coefficient of the material of the inner section and/or sealing means need not be identical with that of the material of the shell 2. Also, expansion or contraction of the inner section 101, 201 or 301 need not move such inner section out of a position of coaxiality with the shell 2 even if the shell does not expand or contract (or expands or contracts at a rate different from that of the inner section).

Figure 5:
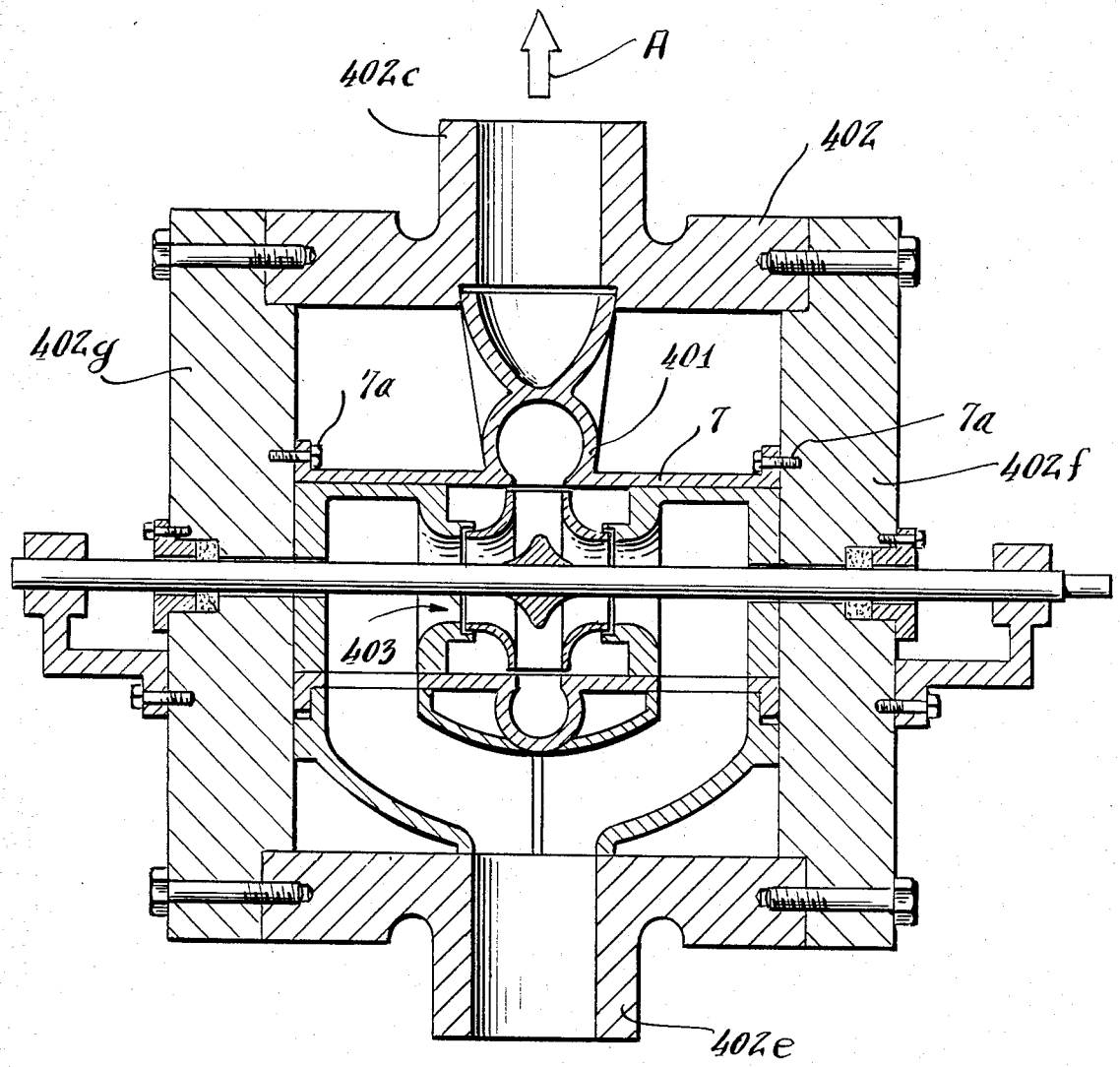
FIG. 5 is an axial sectional view of a centrifugal pump wherein the inner section is suspended in the outer section by means of a pipe whose end portions are bolted to the rigid end walls of the outer section.

FIG. 5 shows one mode of suspending the volute-type inner section 401 in the outer section or shell 402 of the casing. The suspending means comprises a pipe 7 which is coaxial with the rotor 403 and is secured to the detachable rigid end walls 402*f*, 402*g* of the shell 402 by fasteners 7*a*. The end walls 402*f*, 402*g* are designed to stand pronounced deforming stresses.

In the embodiment of FIG. 5, the pipe 7 is integral with the inner section 401. However, it is equally possible to employ suspending means whose pipe is welded or threadedly connected (e.g., by means of fasteners) to the shell 402. If desired, one end portion of the pipe 7 can be a close-dimension fit in a recess of the respective end wall 402*f* or 402*g* to allow for some axial movements of the pipe 7 and inner section 401 relative to the shell 402. With reference to FIG. 5, this would mean that the fastener means 7*a* connecting the pipe 7 to the end wall 402*f* or 402*g* is omitted and the respective end portion of the pipe 7 fits into a complementary recess in the internal surface of the respective end wall. In many instances, the mounting of the pipe 7 in a manner as shown in FIG. 5 (i.e., a connection of both ends to the shell 402) is preferred for the sake of reliability and stability.

The sectional view of FIG. 5 is taken at right angles to the sectional view of FIGS. 1, 2, 3 or 4. The pressurized fluid issues from the shell 402 in the direction of arrow A. The nipples of the shell 402 are shown at 402*c* and 402*e*.

Other parts of the pump shown in FIG. 5 (such as a drive shaft for the rotor 403, stuffing boxes for the drive shaft, impeller means, etc.) are standard components whose construction and/or mounting forms no part of the invention.

Figure 6:
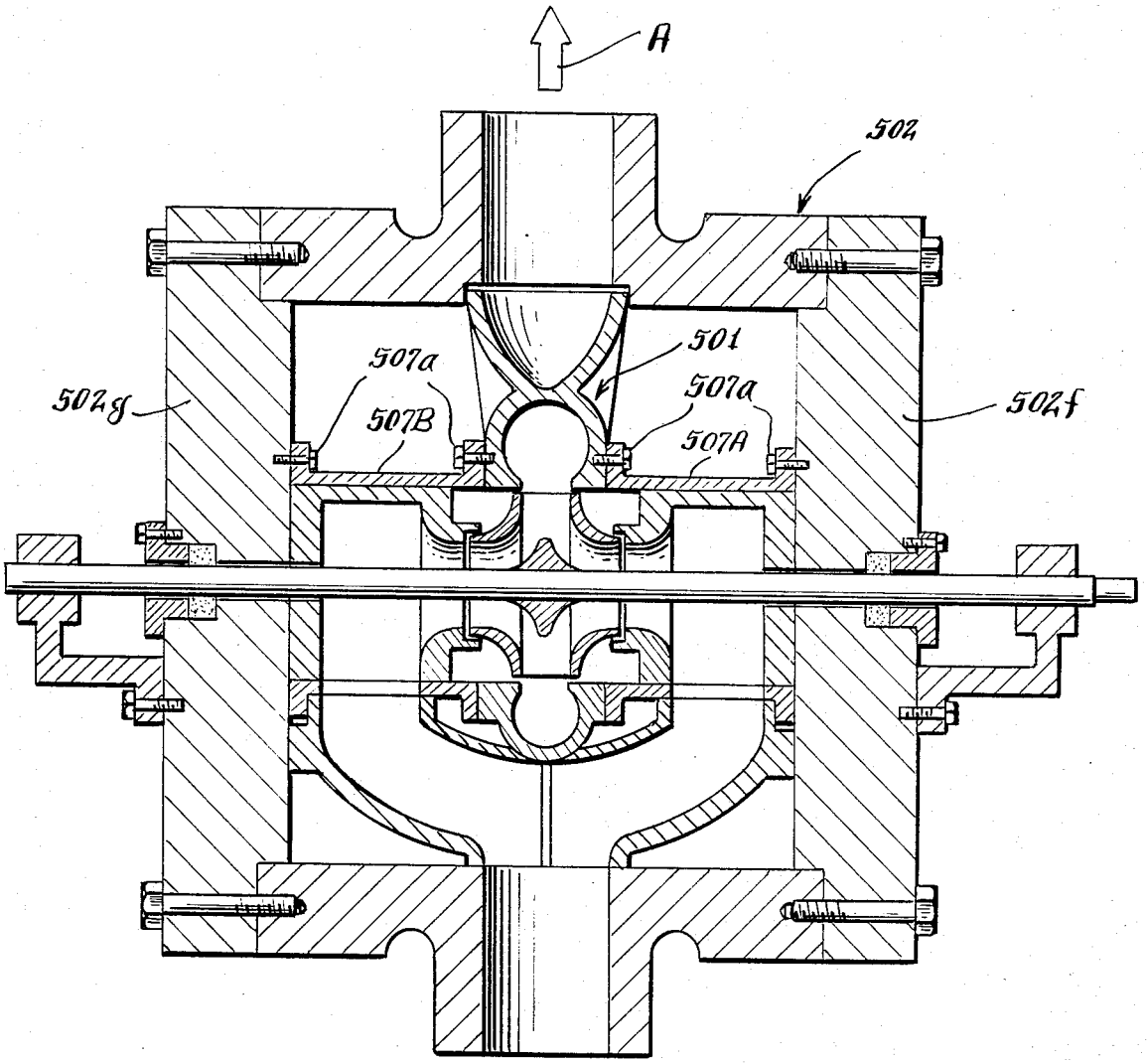
FIG. 6 is an axial sectional view of a further centrifugal pump wherein the inner section is suspended on a two-piece pipe.

FIG. 6 shows an embodiment wherein the pipe of the means for suspending the volute-type inner section 501 in the outer section or shell 502 of the casing comprises two coaxial portions 507A, 507B. The portion 507A is bolted to the end wall 502*f* and to the inner section 501, and the portion 507B is bolted to the end wall 502*g* and to the inner section 501. The fastener means are shown at 507*a*.

In all other respects, the pump of FIG. 6 is identical with or analogous to that of FIG. 5. It will be noted that the regions of contact between the pipe 7 or 507A + 507B and the end walls of the shell 402 or 502 are remote from the axis of the rotor means. Such regions are preferably annular and concentrically surround the axis of the rotor means.

Figure 7:
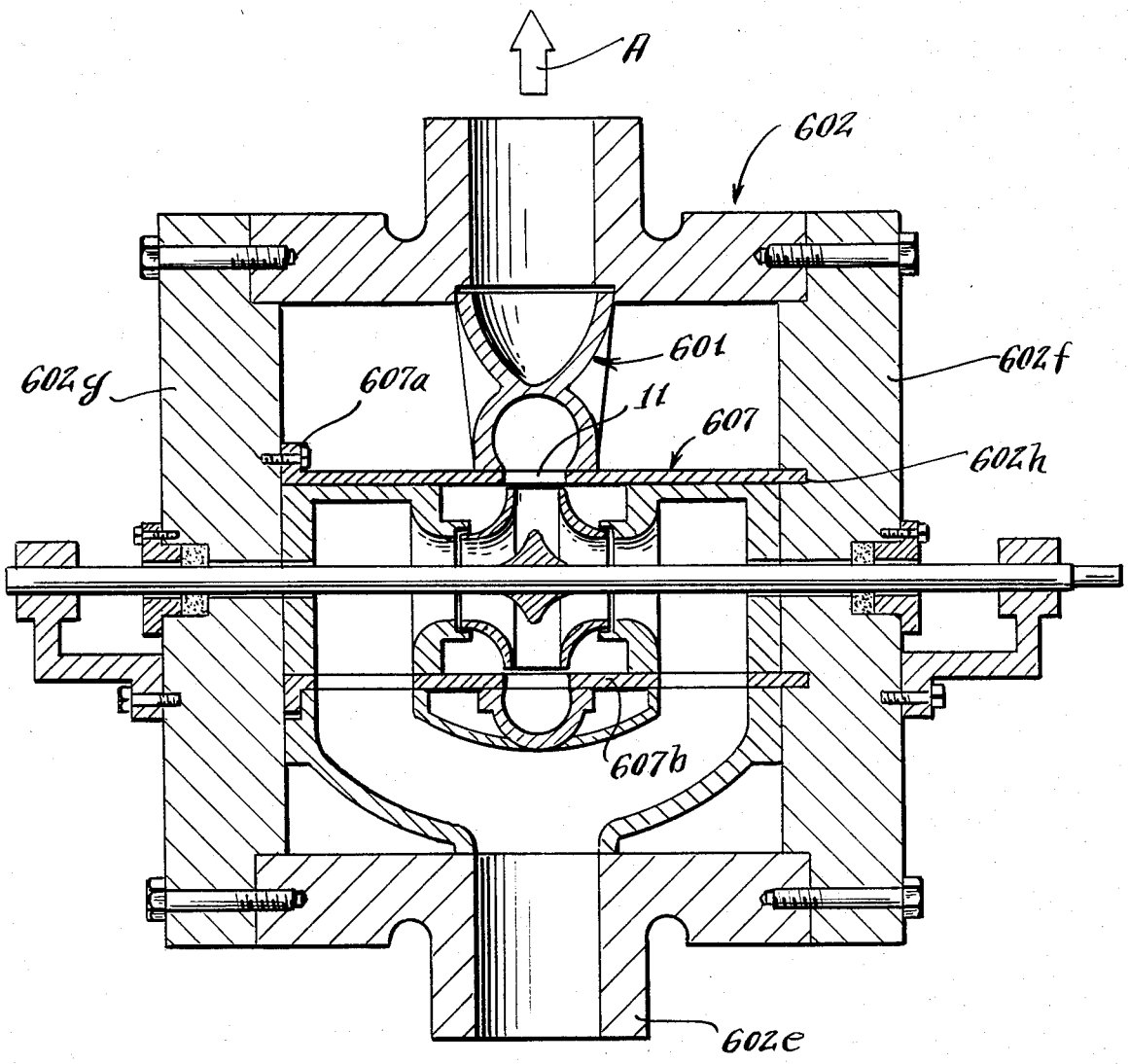
FIG. 7 is an axial sectional view of a centrifugal pump wherein one end portion of the pipe is reciprocable in a recess machined into the inner side of one end wall of the outer section.

Referring to FIG. 7, the volute-type inner section 601 is suspended in the outer section or shell 602 of the casing by a one-piece elongated pipe 607 having a portion 607*b* which is disposed in the region of the fluid-admitting nipple 602*e* and serves as a guide vane wheel for the inflowing fluid. The left-hand end portion of the pipe 607 is bolted to the end wall 602*g* by fasteners 607*a*, and the right-hand end portion of the pipe 607 extends into and is reciprocable in an annular recess 602*h* at the inner side of the end wall 602*f*. The reference character 11 denotes an opening in the pipe 607. This opening admits fluid into the interior of the inner section 601.

Figure 8:
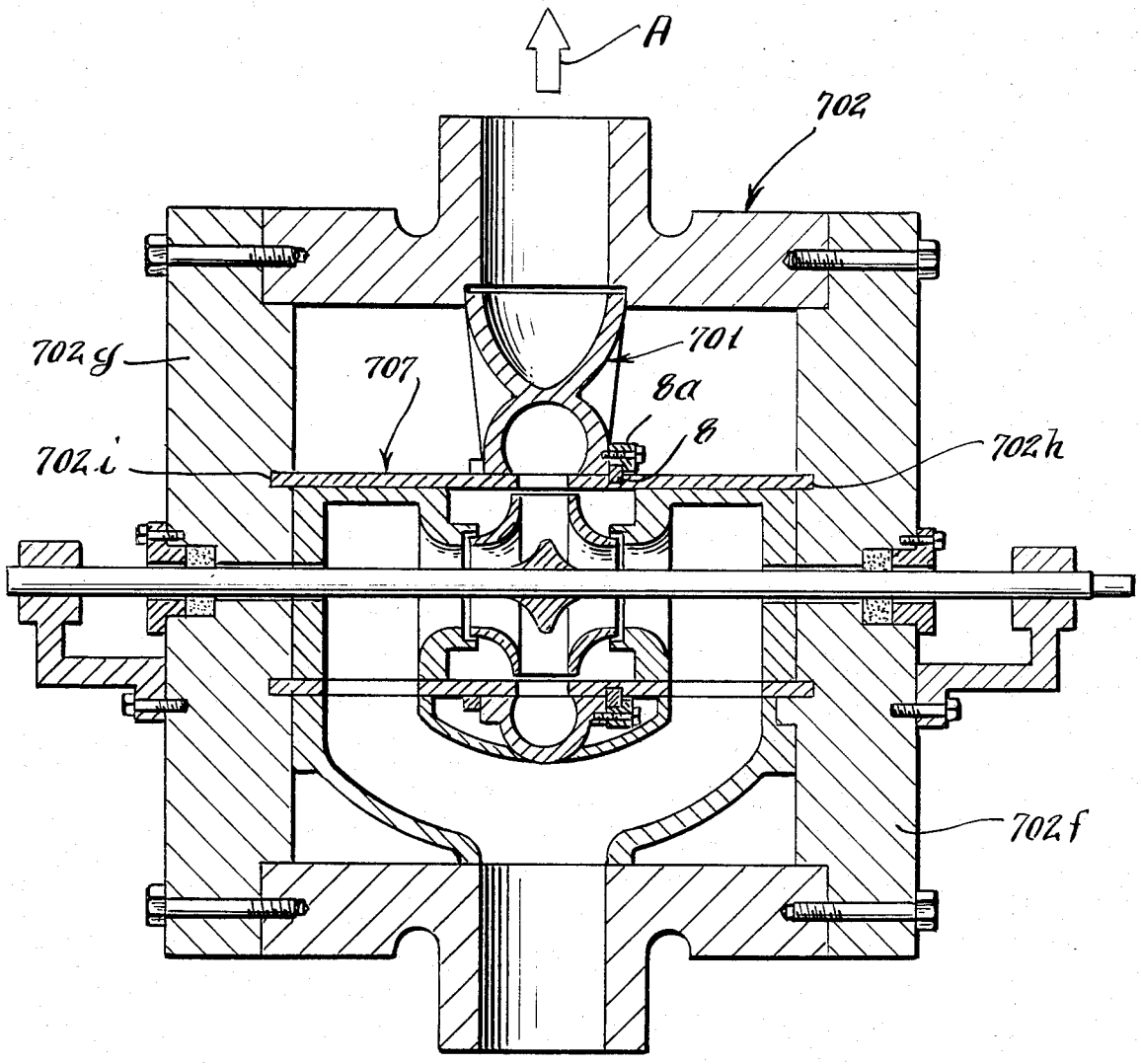
FIG. 8 is an axial sectional view of a pump wherein the pipe is fixedly secured to and stiffens the inner section of the casing.

In the embodiment of FIG. 8, both ends of the suspending pipe 707 for the volute-type inner section 701 of the casing extend into recesses (702*h*, 702*i*) in the inner sides of the respective end walls 702*f*, 702*g* of the outer section or shell 702. The inner section 701 is clamped in position and thereby stiffened by a locating ring 8 which extends into a circumferential groove of the pipe 707 and by a second ring 8*a* or another suitable hold-down means which is separably fastened to the inner section 701 and has an internal groove for the radially outermost portion of the ring 8. The rings 8 and 8*a* cooperate to hold the inner section 701 against undesirable axial movement in the interior of the shell 702. The ring 8 may be replaced by or may constitute one race of a radial bearing for the inner section 701.

Figure 9:
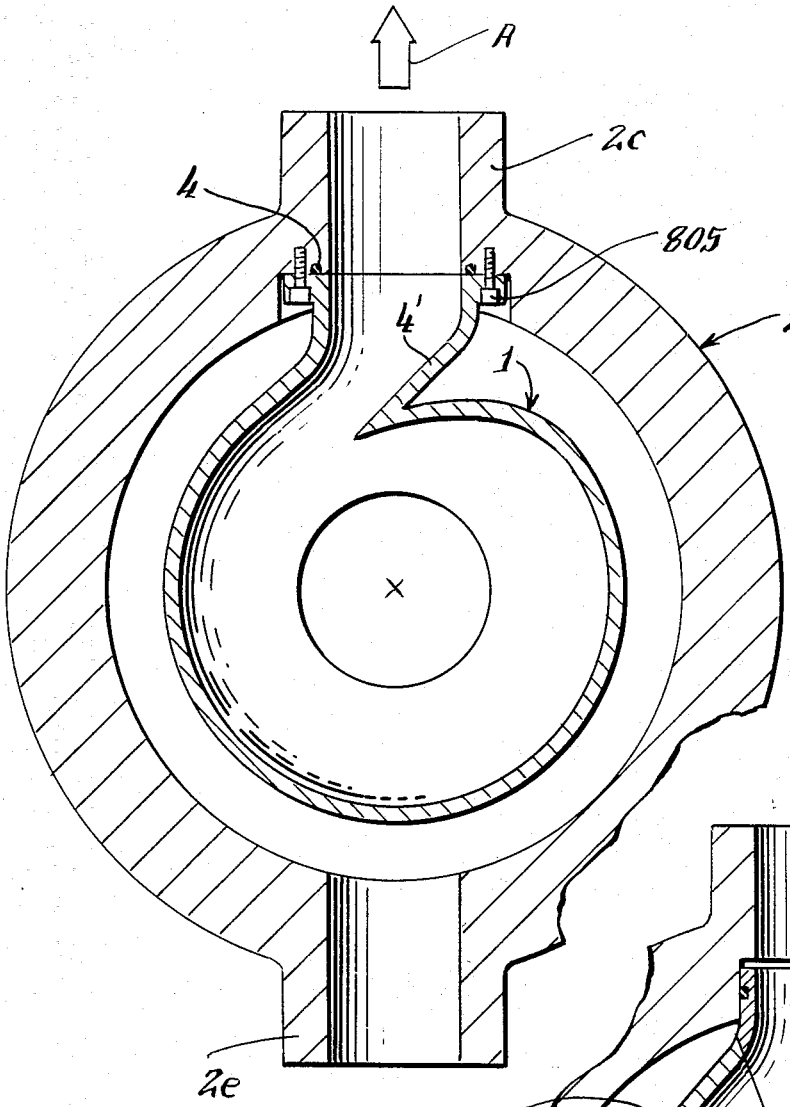
FIG. 9 is a transverse sectional view of a centrifugal pump which constitutes a modification of the pump shown in FIG. 1.

FIG. 9 shows a portion of a centrifugal pump which is practically identical with the pump of FIG. 1 except that the fasteners 805 are recessed into the extension 4' of the inner section 1. The sealing ring is shown at 4, the fluid evacuating nipple at 2*c*, and the fluid admitting nipple at 2*e*. The fasteners 805 form part of means for suspending the inner section 1 in the shell 2 of the casing.

Figure 10:
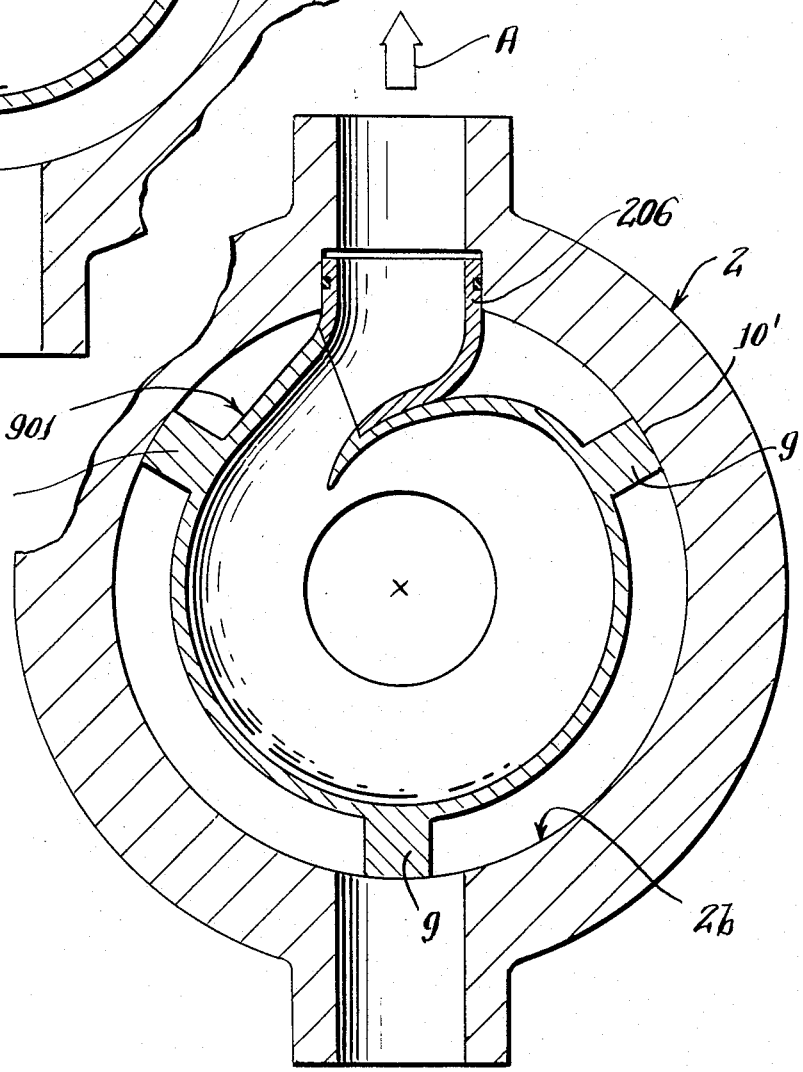
FIG. 10 is a transverse sectional view of a centrifugal pump wherein the inner section of the casing has three equidistant locating or centering projections abutting against the internal surface of the outer section.

FIG. 10 shows a portion of a centrifugal pump which is similar to that of FIG. 3. The inner section 901 has several radially outwardly extending locating projections 9 whose outer end faces 10' abut against the internal surface 2*b* of the shell 2. In the illustrated embodiment, the inner section 901 is formed with three equidistant or nearly equidistant locating projections 9 (as considered in the circumferential direction of the shell 2) which are integral therewith. It is equally possible to provide projections which are welded or threadedly connected to the inner section 901. The latter may constitute a casting. The end faces or outer end faces 10' of the projections 9 lie flush against and are preferably a close-dimension fit in the adjacent portions of the internal surface 2*b*. The projections 9 form part of or constitute the means for suspending the inner section 901 in the shell 2.

Figure 11:
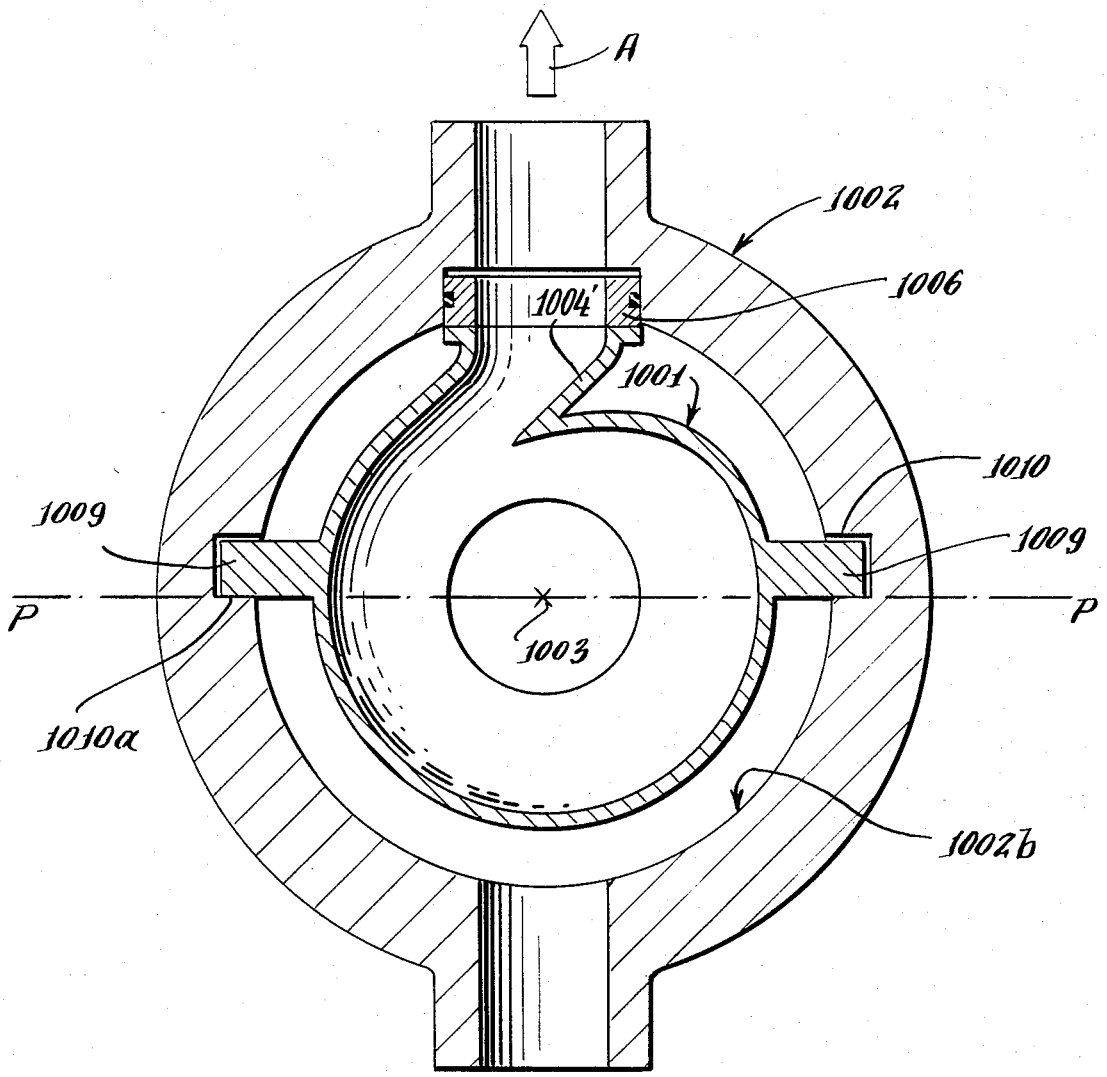
FIG. 11 is a transverse sectional view of an additional centrifugal pump which constitutes a modification of the pump shown in FIG. 10 and allows for some movement of the inner section transversely of the outer section of the casing.

FIG. 11 illustrates a modification of the structure which is shown in FIG. 10. The inner section 1001 resembles the inner section 101 of FIG. 2 and its extension 1004' is adjacent to a plunger-like tubular insert 1006 of the sealing means. The inner section 1001 is further formed with two outwardly extending integral locating projections 1009 which form part of or constitute the suspending means for the section 1001 and extend into complementary recesses 1010 machined into the internal surface 1002*b* of the shell 1002. The projections 1009 are located at one side of a plane P—P which extends through the rotor axis 1003. These projections rest on the surfaces 1010*a* (located in the plane P—P) which bound portions of the respective recesses 1010. The arrangement of FIG. 11 allows for at least some radial expansion or contraction of the inner section 1001 without moving the axis 1003 of the rotor out of register with the axis of the shell 1002. The recesses 1010 may constitute grooves extending in parallelism with the axis 1003.

The improved centrifugal pump is susceptible of many additional modifications without departing from the spirit of the invention. For example, the projections 1009 of FIG. 11 can be welded or separably fastened to the volute-type inner section 1001. Also, such projections (or projections of the type shown in FIG. 10) can be provided on the inner section of the pump shown in FIG. 1 or 4. The fasteners 5 of FIG. 1 can be omitted or replaced with other means for securing the extension 4' of the inner section 1 in the recess 2*a*. The pump may comprise one or more stages, and the material of the outer section or shell can be selected practically at will because this shell need not be welded to the inner section. Additional modifications will readily occur to men skilled in the art upon perusal of the preceding description of the presently preferred embodiments.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. In a centrifugal pump, particularly in a high pressure pump for use in power plants or the like, the combination of a casing including an inner section having an internal passage for the flow of a fluid therethrough, and an outer section surrounding and being detachably connected to said inner section and having another passage for the flow of a fluid therethrough; rotor means in said casing; sealing means interposed between said sections and including an extension establishing fluid communication between said internal passage and said other passage, said extension being fixed to said inner section and being radially freely movable relative to said outer section to thereby permit relatively uninhibited differential thermal expansion of said sections; and means for suspending said inner section in said outer section, said suspending means engaging said outer section radially outwardly of the axis of said rotor means, and said suspending means bein disposed outwardly of said rotor means as considered in the axial direction of the latter.

2. The combination of claim 1, wherein said other passage is a discharge passage.

3. The combination of claim 1, wherein said inner section and said outer section cooperate to define a space which at least partly surrounds said inner section and is adapted to communicate with said internal passage when said inner section is detached from said outer section.

4. In a centrifugal pump, particularly in a high pressure pump for use in power plants or the like, the combination of a casing including an inner section having an internal passage for the flow of a fluid therethrough, and an outer section surrounding and being detachably connected to said inner section, said inner section and said outer section cooperating to define a space which at least partly surrounds said inner section and is adapted to communicate with said internal passage when said inner section is detached from said outer section, and said outer section having a discharge passage for the flow of a fluid therethrough, and an inlet passage which opens into said space; rotor means in said casing; sealing means interposed between said sections and including an extension establishing fluid communication between said internal passage and said discharge passage, said extension being fixed to said inner section and being radially freely movable relative to said outer section to thereby permit relatively uninhibited differential thermal expansion of said sections; and means for suspending said inner section in said outer section, said suspending means engaging said outer section radially outwardly of the axis of said rotor means.

5. The combination of claim 4, wherein said extension forms part of said inner section is disposed substantially radially of said rotor means, and engages said outer section.

6. The combination of claim 4, wherein said outer section has an internal surface with a recess disposed substantially radially of said rotor means and receiving a portion of said extention so that the latter is movable radially of the axis of said rotor means.

7. The combination of claim 6, wherein said extention has a flat end face.

8. The combination of claim 4, wherein said extention includes a tubular insert which is movable radially of the axis of said rotor means and said outer section has an internal surface with a recess reciprocably receiving at least a portion of said insert.

9. The combination of claim 4, wherein said extention includes a tubular component which is rigid with said inner section and is deformable in response to pressure which develops in the casing when the pump is in use whereby the thus deformed component bears against the other of said sections.

10. The combination of claim 4, wherein said outer section has an internal surface and said inner section comprises several locating projections forming part of said suspending means and extending outwardly from said inner section, said projections having outer end faces abutting against said internal surface.

11. The combination of claim 10, wherein said projections are integral with said inner section.

12. The combination of claim 10, wherein said projections are bonded to said inner section.

13. The combination of claim 10, further comprising means for separably fastening said projections to said inner section.

14. The combination of claim 10, wherein said projections are a close-dimension fit in said outer section.

15. The combination of claim 4, wherein said inner section has several external locating projections forming part of said suspending means and extending substantially radially of the axis of said rotor means, said outer section having an internal surface with recesses for portions of said projections.

16. The combination of claim 15, wherein said recesses are grooves extending in parallelism with the axis of said rotor means.

17. The combination of claim 4, wherein said suspending means comprises a pipe which is coaxial with said rotor means.

18. The combination of claim 17, wherein said outer section has a pair of rigid end walls; and further comprising means for fastening said pipe to at least one of said end walls.

19. The combination of claim 17, wherein said outer section has two rigid end walls and at least one of said end walls has an annular recess for one end portion of said pipe.

20. The combination of claim 17, further comprising means for stiffening said inner section, said stiffening means including clamping means separably connecting said inner section to said pipe.

21. The combination of claim 17, further comprising radial bearing means interposed between pipe and said inner section.

22. The combination of claim 17, wherein said inner section has means for admitting fluid into its interior and said pipe includes guide vane means in the region of said fluid admitting means.

23. The combination of claim 4, wherein said suspending means is devoid of welded seams.

24. The combination of claim 4, wherein said discharge passage extends substantially radially of the axis of said rotor means.

25. The combination of claim 4, wherein said extension and said discharge passage are located substantially centrally of said casing.

26. The combination of claim 4, wherein said inner section is of the volute type, said outer section being resistant to pressure.

27. The combination of claim 4, wherein said extension is separably secured to said one section.

28. The combination of claim 4, wherein said extension is a discrete part separate from said inner and outer sections.

* * * * *